United States Patent [19]

Vosbikian

[11] Patent Number: 4,794,663

[45] Date of Patent: Jan. 3, 1989

[54] FLEXIBLE DUST MOP

[75] Inventor: Peter S. Vosbikian, Moorestown, N.J.

[73] Assignee: Quickie Manufacturing Company, Inc., Cinnaminson, N.J.

[21] Appl. No.: 20,580

[22] Filed: Mar. 2, 1987

[51] Int. Cl.[4] ..... A47L 13/24

[52] U.S. Cl. ..... 15/229.6; 15/144 B; 15/144 R; 15/145

[58] Field of Search ..... 15/229.3–229.7, 15/144 A, 143 B, 144 R, 143 R, 145; 16/112, 331, 332

[56] References Cited

U.S. PATENT DOCUMENTS

| | | | |
|---|---|---|---|
| 390,142 | 9/1888 | Ryan | 15/145 |
| 432,130 | 5/1890 | Fenton | 15/144 A |
| 688,153 | 12/1901 | Ayer | 15/145 |
| 1,821,481 | 9/1931 | Schempp | 15/143 B |
| 4,524,484 | 6/1985 | Graham | 15/143 B |
| 4,658,461 | 4/1987 | Roe et al. | 15/145 |

*Primary Examiner*—Edward L. Roberts
*Assistant Examiner*—J. Dwight Poffenberger, Jr.
*Attorney, Agent, or Firm*—Steele, Gould & Fried

[57] ABSTRACT

A flexible dust mop is disclosed which includes an elongate handle which preferably includes a telescoping portion. The handle is formed with an upper, rigid, non-flexible upper portion and a lower flexible portion secured to the rigid portion. The flexible handle portion terminates downwardly in a bottom connector which includes a pivotal connection and a first ratchet. A dust mop head is pivotally secured to the handle at the pivotal connection and includes a second ratchet which is engageable with the first ratchet. Once the dust mop head is pivotally moved in angular relationship to the handle, the interengagement between the first and second ratchets serves as a detent to tend to maintain the dust mop in the angularly adjusted position.

6 Claims, 3 Drawing Sheets

FIG. 1
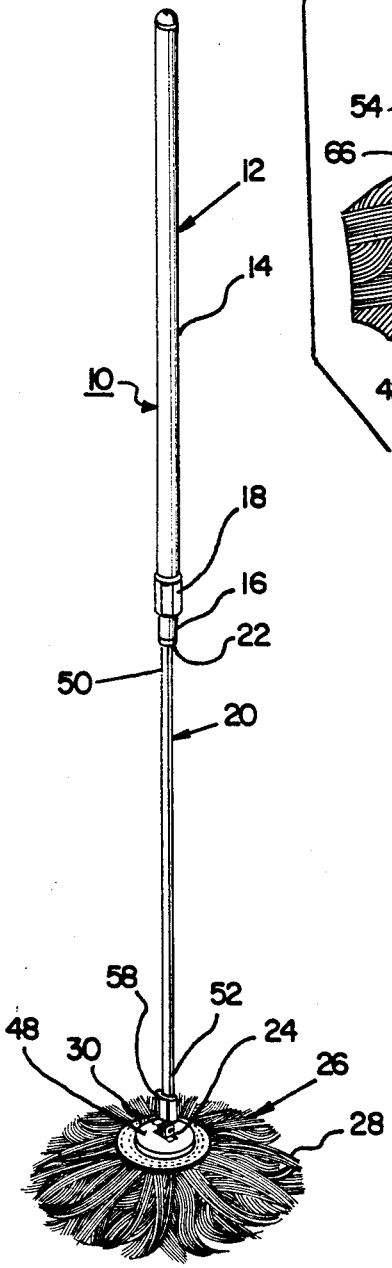
FIG. 3
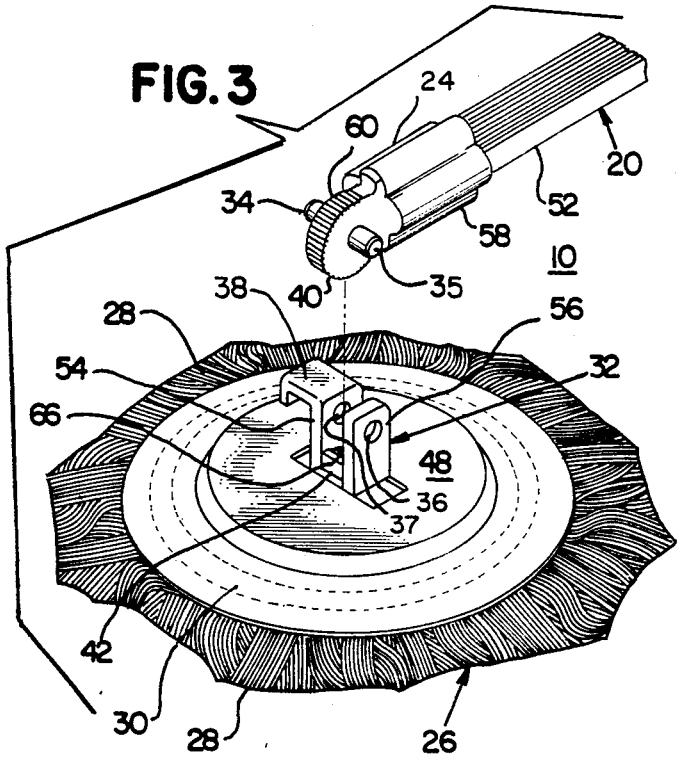
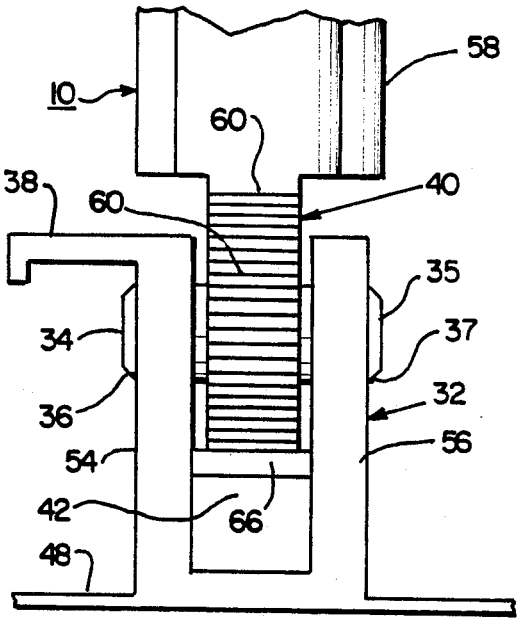
FIG. 4

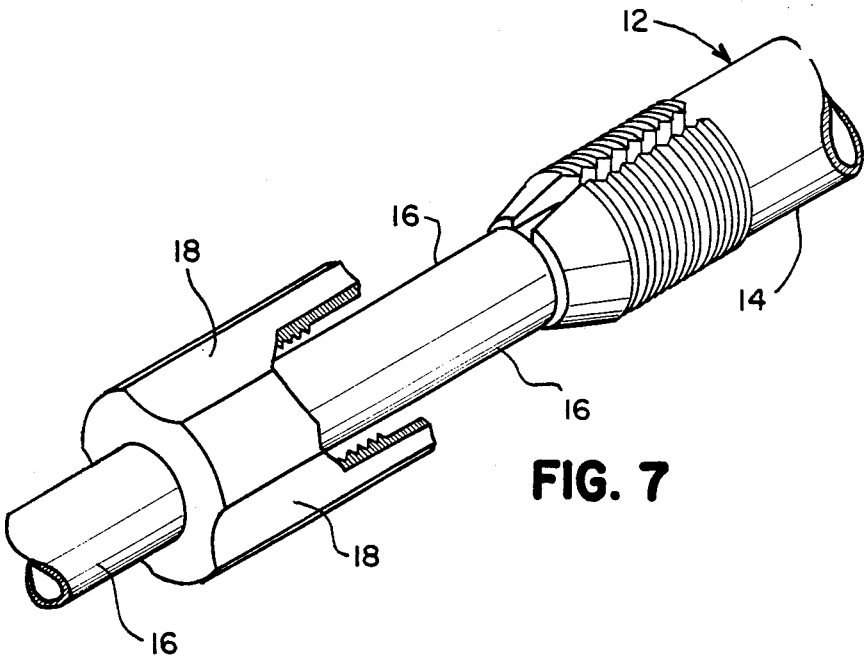
FIG. 7
FIG. 8
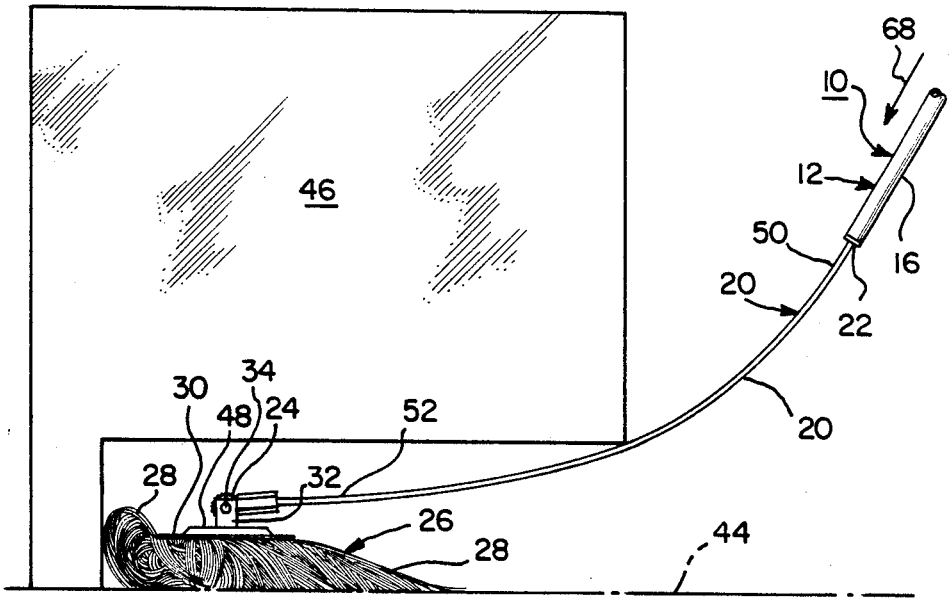

FLEXIBLE DUST MOP

BACKGROUND OF THE INVENTION

1. Field of the Invention

The present invention relates generally to the field of cleaning implements, and more particularly, is directed to a dust mop including an elongate handle, the handle comprising an upper rigid portion, a lower flexible portion and a replaceable head connected to the bottom of the flexible handle portion.

2. Discussion of the Prior Art

Prior workers in the art have long developed many types of cleaning implements for use in and about homes, commercial establishments, schools, industrial plants and the like. Generally speaking, the prior art cleaning implements have included brooms and brushes of many varieties and designs for floor sweeping and cleaning purposes and both wet mops and dry mops for specialized cleaning applications.

In the case of dry mops, the prior art types of dry mops or dust mops have normally included an elongate handle and a dust mop or dust head which is usually connected to the handle in a pivotal connection. The prior art mop heads usually are composed of a plurality of strands of fibrous material such as cotton or various plastic yarns which are interconnected in a manner to resist disassociation. While the prior art types of dust mops have been known to include a pivotal interconnection between the mop head and the handle, these pivotal interconnections have tended to become rather loose and floppy during use. Also, reliable and quick acting mechanisms to allow mop head replacement in an easy manner have yet to be developed. When dusting floors and other lower surfaces, the loose interconnection between the mop head and the handle was usually of little consequence inasmuch as the angle of the handle relative to the floor determined the angularity of the mop head. However, when working overhead, for example when dusting ceilings or the upper portions of large pieces of furniture, the loose connection would usually result in unintended or unwanted pivoting of the mop head relative to the handle, thereby making the overhead cleaning chore that much more difficult.

Additionally, when it was necessary to use the prior art mop construction to clean hard to reach areas, for example, floor surfaces beneath furniture, and beneath beds and the like, it was necessary for the user to bend or stoop in order to lower the handle sufficiently to pass under and reach under the furniture or other obstructions. This continuing bending and stooping has proved to be quite tiresome for the user and in some cases, where the user was elderly or otherwise infirm, such cleaning chores when using the presently available mop constructions was substantially impossible.

It is therefore an object of the present invention to provide an improved flexible dust mop of the type set forth.

It is another object of the present invention to provide a novel flexible dust mop comprising a handle having flexible means and a mop head connected to the flexible means in a manner to allow cleaning under pieces of furniture by flexing the handle rather than by bending or stooping on the part of the user.

It is another object of the present invention to provide a novel flexible dust mop comprising an elongate handle, the handle having an upper, rigid portion and a lower, flexible portion, a mop head connected to the bottom end of the flexible portion whereby a great degree of flexibility can be imparted to the handle to allow cleaning under large floor mounted objects.

It is another object of the present invention to provide a novel flexible dust mop comprising an elongate handle, the handle being divided into an upper, rigid handle portion and a connected, lower, flexible, fiberglass handle portion, the fiberglass handle portion being provided with a first partial ratchet, a mop head connected to the bottom of the fiberglass handle portion, the mop head being provided with a handle being interconnectable with the ratchet of the mop head in a manner to provide a releasable detent therebetween and release means at the bottom of the handle to facilitate easy replacement of the mop head.

It is another object of the present invention to provide a novel flexible dust mop that is simple in construction, inexpensive in manufacture and trouble free when in use.

Other objects and a fuller understanding of the invention will be had by referring to the following description and claims of a preferred embodiment, thereof, taken in conjunction with the accompanying drawings, wherein like reference characters refer to similar parts throughout the several views and in which:

BRIEF DESCRIPTION OF THE DRAWINGS

FIG. 1 is a perspective view of the flexible dust mop constructed in accordance with the teachings of the present invention.

FIG. 3 is an enlarged, partial, exploded, perspective view of the interconnection between the handle and the dust mop head.

FIG. 4 is an enlarged elevational view of the handle and mop head interconnection.

FIG. 7 is an enlarged, partial and partly exploded view of the telescoping handle adjustment with parts broken away to expose interior construction features.

FIG. 8 is a diagrammatic view showing the flexible dust mop in use.

DESCRIPTION OF THE PREFERRED EMBODIMENT OF THE INVENTION

Figure 2:
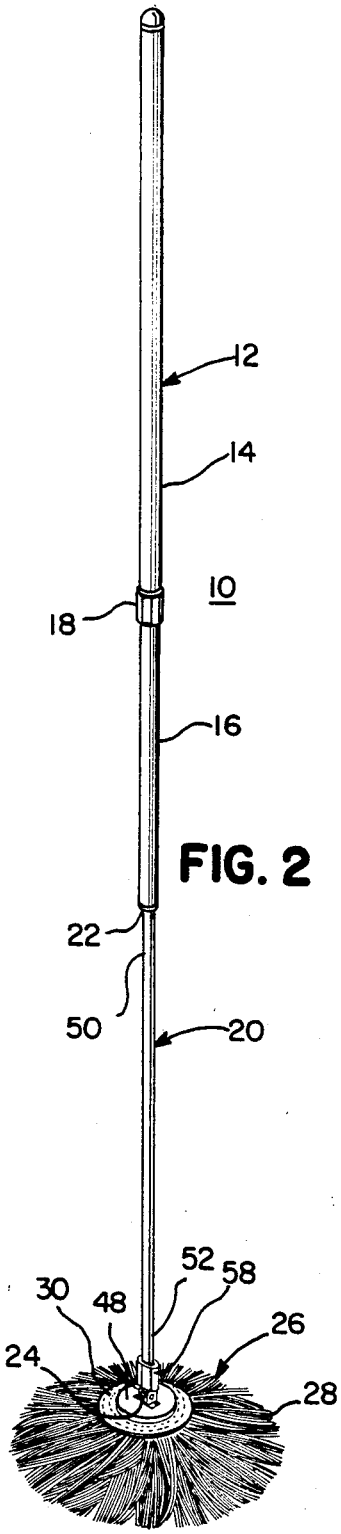
FIG. 2 is a perspective view similar to FIG. 1 showing the telescoping handle construction.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIG. 1 a flexible dust mop generally designated 10 which comprises a handle 12 and a mop head 26 which is pivotally connected to the bottom of the handle. The mop head 26 is conventional in configuration and manufacture and comprises generally a body 48 which may be generally discoid in configuration. The body 48 may be conventionally formed of molded plastic or other suitable material and includes an upper or top surface 30 and a plurality of affixed, peripherally extending and depending dust gathering strands or fibers 28. The fibers 28 conventionally may be fabricated of a natural material such as cotton or of synthetic materials such as polyester yarns, all in well-known manner.

To increase the utility and applicability of the dust mop 10, the handle 12 is preferably designed to be telescopingly extendable and comprises generally an upper, non-flexible handle portion 14 and a middle, non-flexible, telescoping portion 16, which middle portion is telescopingly received within the hollow interior of the handle upper portion 14. A tightening nut 18 is threadedly engaged upon the bottom of the upper handle portion 14 to lock the telescoping handle portion 16 in any desired longitudinally adjusted position relative to the upper handle portion 14. The handle portion 14, 16 may be extended as necessary to lengthen the handle sufficiently to contact hard to reach places, for example ceiling areas, the tops of large items of furniture, ceiling hung lighting fixtures and the like.

Preferably, both the handle upper portion 14 and the handle telescoping portion 16 are fabricated of lightweight, hollow, metallic tubing to provide a sturdy, inexpensive handle construction which is fabricated of lightweight materials to enable a user, such as a housewife, to easily lift the dust mop 10 and to use the dust mop without requiring great strength or without requiring a great exertion. All that is necessary to use the dust mop of the present invention is to easily and simply lift and move the flexible dust mop to dust the desired areas.

The non-flexible telescoping handle portion 16 terminates downwardly in a suitable socket or other interconnection 22 to receive therein in stationary, secure relationship the upper end 50 of the lower, flexible handle portion 20. It is an important feature of this invention to fabricate the lower flexible portion 20 of a sturdy, extremely flexible, and lightweight material to facilitate the introduction of the mop head 26 into hard to reach places, for example under heavy non-movable items of furniture, such as sofas and beds without requiring the user to stoop or bend. One such material that has been found suitable for this purpose is solid, fiberglass bar stock of either rectangular or circular cross-sectional configuration. Such material is readily available and has been popularly employed for use in many different environments in view of its strength, its inherent, highly flexible characteristic, its light weight, and its natural memory to return to its original straight configuration once the exterior forces tending to bend the length the fiberglass material have been removed.

Figure 5:
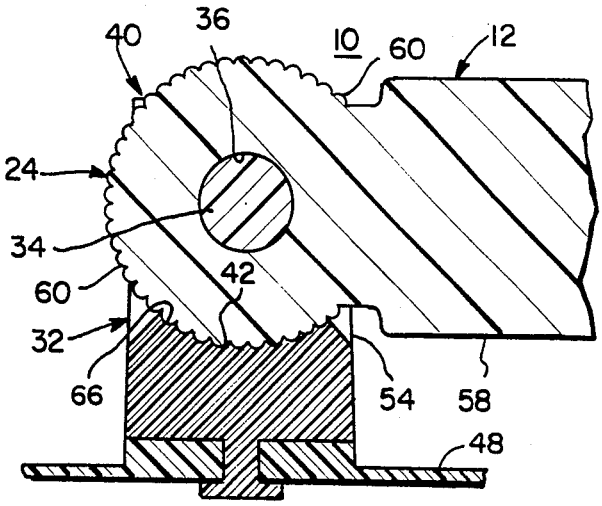
FIG. 5 is a cross-sectional view through the interconnection of FIG. 4 showing the parts in a first angular relationship.

The bottom end 52 of the flexible or fiberglass handle portion 20 is provided with a securely attached mop head connector 24 which is designed to provide a pivotal interconnection between the mop handle 12 and the mop head 26. The bottom connector 24 may be fabricated of suitable plastic or metal and preferably is injection molded in one part to provide a lightweight, strong and inexpensive construction element. The bottom connector 24 comprises generally a circular ratchet element 40 and a pair of laterally extending pivot pins 34, 35. Preferably, as shown in FIGS. 4 and 5, the pivot pins 34, 35 are concentric with the circular ratchet element 40. The connector 24 comprises a suitable socket 58 of size and configuration to receive and secure the bottom end 52 of the fiberglass handle portion 20 in a substantially non-removable interconnection. The circular ratchet 40 comprises a plurality of ratchet teeth 60 integrally formed in the connector 24 in facing relationship to the mop head 26 to form an easily adjustable mop head detent in the manner hereinafter more fully set forth.

Figure 6:
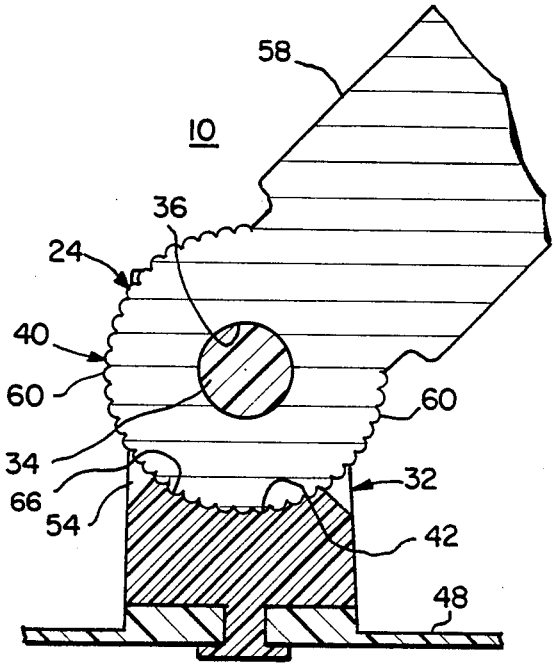
FIG. 6 is a cross-sectional view similar to FIG. 5 showing the parts in a second angular relationship.

As best seen in FIG. 3, and additionally referring to FIGS. 5 and 6, the upper surface 30 of the mop head body 48 is centrally equipped with a cooperating connecting bracket 32 of size and configuration to removably interfit with the pivotal connector 24 of the handle 12. As shown, the mop head bracket 32 comprises generally a pair of spaced, upwardly extending lugs 54, 56 of size and design to receive therebetween the circular ratchet element 40 of the handle connector 24. The first and second pivot pins 34, 35 of the bottom connector 24 project laterally outwardly from the circular ratchet element 40 and are received within the pivot holes or pivot openings 36, 37 formed in the lugs 54, 56 to provide the pivotal interconnection of the parts. At least one of the connector lugs 54, 56 is preferably equipped with a radially outwardly extending finger lever 38 to facilitate slight outward movement of one of the bottom lugs 54 or 56 when it is necessary to remove and replace the mop head 26.

The bracket 32 further comprises an arcuate ratchet 42 having teeth 66 formed therein of suitable size and configuration to interfit and cooperate with the bottom connector ratchet teeth 60 to thereby form a ratchet detent between the handle 12 and the mop head 26. Accordingly, when the mop handle connector pivot pins 34, 35 are positioned within the cooperating connector bracket pivot openings 36, 37, the ratchet teeth 66 of the mop head bracket 32 will be in engagement with the ratchet teeth 60 of the handle connector ratchet 40.

In use, a user, such as a housewife, (not shown) can grasp the flexible mop 10 at the non-flexible handle upper portion 14 thereof. When it is desired to reach high places such as a ceiling, the nut 18 can be loosened and the non-flexible telescoping portion 16 can be telescopingly extended relative to the handle upper portion 14. When the desired handle length is achieved, the parts can be secured in the longitudinally adjusted position by tightening the nut 18 in known manner. The mop head 26 can then be applied in the hard-to-reach locations, such as the corner portions of ceiling constructions, whereupon the angularity of the handle relative to the portion of the building construction being dusted will apply pivotal forces upon the interconnection between the handle bottom connector 24 and the mop head bracket 32. This will cause sufficient pivotal forces applied at the interconnection between the respective ratchet teeth 60, 66 to pivot the mop head 26 relative to the handle 12 at the pivotal interconnections 34, 36 and 35, 37. When the proper angularity has been reached for the task at hand, the ratchet teeth 60, 66 will again be engaged to thereby serve as a detent to tend to maintain the angularity of the parts. The interaction between the mop head ratchet 42 and the connector ratchet 40 serves to prevent uncontrolled flopping or free pivotal movement of the mop head 26 relative to the mop handle 12. It will be observed that the ratchet teeth 60, 66 are shallow formed so as to permit movement of the mop head 26 relative to the handle 12 upon the application of relatively small pivoting forces. The shallow interconnection between the ratchet teeth provides a sufficient detent to prevent flopping.

When it is desired to apply the flexible mop 10 to areas at low level that may be beneath large pieces of furniture 46, instead of requiring the user to stoop or bend as was necessary with prior art rigid handle constructions, the user can now push downwardly on the non-flexible handle portion 14 in the direction of the arrow 68 as shown in FIG. 8, to thereby flex or bend the fiberglass lower handle portion 20 as illustrated. In the manner illustrated, the flexure of the fiberglass handle portion 20 will allow the mop head 26 to travel over the floor 44 and under the furniture 46 to thereby facilitate cleaning the dust from under the furniture without requiring the user to bend. With this flexible handle construction, an aged user, or perhaps a person having back problems can utilize the flexible dust mop 10 of the present invention without requiring uncomfortable or impossible bending. Once the bending forces are removed from the handle 12, the natural memory of the fiberglass material will cause the handle fiberglass portion to again straighten, as shown in FIGS. 1 and 2. While the flexible handle of the present invention has been described with relation to a dust mop head 26, it will be appreciated that such a flexible handle could be likewise be applied to a variety of other implements, such as brooms, wet mops, brushes, painting implements and the like and still fall within the meaning and intent of this application.

Although the present invention has been described with reference to the particular embodiments herein set forth, it is understood that the present disclosure has been made only by way of example, and that numerous changes in the details of the construction may be restored to without departing from the spirit and scope of the invention. Thus, the scope of the invention should not be limited by the foregoing specification, but rather, only by the scope of the claims appended hereto.

What is claimed is:

1. A dust mop comprising:

an elongated handle, the handle comprising a non-flexible upper portion and a flexible lower portion;

a pivotal connector bottomly secured to the flexible portion of the handle, the pivotal connector comprising a first arcuate ratchet, the pivotal connector comprising a pivot pin extending laterally outwardly from first arcuate ratchet, the first arcuate ratchet comprising a plurality of first shallow teeth defined by shallow valleys;

a mop head pivotally connected to the handle at the said bottom connector, the mop head comprising a body and a plurality of dust gathering fibers depending from the body; and a connector bracket affixed to the mop head to secure the mop head to the handle connector, the connector bracket comprising a second arcuate ratchet, the connector bracker receiving the pivotal connector therein with the first arcuate ratchet in arcuate contact with the second arcuate ratchet, the second arcuate ratchet comprising a plurality of second shallow teeth defined by second shallow valleys, the first shallow teeth being positioned in the second shallow valleys and the second shallow teeth being positioned in the first shallow valleys to form a detent sufficiently strong to prevent flopping and sufficiently weak to permit movement of the mop head relative to the handle upon the application of relatively small pivoting forces;

whereby the interconnection between the mop head and the handle serves as a detent to restrain the angularity of the mop head relative to the handle in any one of a plurality of angularly adjusted positions.

2. The dust mop of claim 1 wherein the mop head connector bracket comprises a pair of spaced first and second lugs, the lugs having pivot openings therein, the pivot pin being inserted into the pivot openings to provide a pivotal interconnection between the handle and the mop head.

3. The dust mop of claim 2 wherein one said connector bracket lug comprises an integral finger lever, the finger lever being adapted to pull the one lug away from the second lug to facilitate mop head replacement.

4. The dust mop of claim 3 wherein the handle upper portion comprises a cooperating pair of non-flexible tubes, the non-flexible tubes being arranged in telescoping relationship.

5. The dust mop of claim 4 and a tightening nut engaged on one of the non-flexible tubes, the nut being adapted to secure the non-flexible tubes together in any one of an infinite number of longitudinally adjusted positions.

6. The dust mop of claim 4 wherein the radius of the arc of the second arcuate ratchet is equal to the radius of the arc of the first arcuate ratchet.

* * * * *